United States Patent [19]

Burgin et al.

[11] 4,373,972

[45] Feb. 15, 1983

[54] PRODUCTION OF NICKEL BAR AND ROD

[75] Inventors: Sidney A. Burgin; David J. Latham, both of Sheffield, England

[73] Assignee: British Steel Corporation, London, England

[21] Appl. No.: 326,402

[22] Filed: Dec. 1, 1981

[30] Foreign Application Priority Data

Dec. 2, 1980 [GB] United Kingdom ..... 8038656

[51] Int. Cl.[3] ..... C21D 9/00

[52] U.S. Cl. ..... 148/12 B; 148/12.4

[58] Field of Search ..... 148/12 B, 12.4

[56] References Cited

U.S. PATENT DOCUMENTS

| | | | |
|---|---|---|---|
| 4,011,109 | 3/1977 | Golland et al. | 148/12 B |
| 4,017,338 | 4/1977 | Kozak et al. | 148/12 B |
| 4,106,957 | 8/1978 | Tournoy | 148/12 B |
| 4,146,411 | 3/1979 | Dewsnap et al. | 148/12 B |
| 4,236,551 | 12/1980 | Worgt et al. | 148/12 B |
| 4,242,150 | 12/1980 | Maxwell | 148/12 B |

*Primary Examiner*—W. Stallard

*Attorney, Agent, or Firm*—Bacon & Thomas

[57] ABSTRACT

The invention concerns a method of producing nickel steel rod or bar of a composition including at least 4% by weight nickel and less than 0.2% by weight carbon. The method comprises cooling a rod or bar of such composition on leaving a rolling mill at a rate which is controlled to produce in the cooled rod or bar a microstructure which is predominately martensitic.

6 Claims, No Drawings

PRODUCTION OF NICKEL BAR AND ROD

The invention relates to the production of nickel steel bar and rod. More especially, the invention relates to the production of such bar and rod for concrete reinforcement. By nickel steel is meant a steel containing at least 4% by weight of nickel.

It is well known to use nickel steel plate and sections in structures to be subjected to low temperatures because of their enhanced toughness and strength. These properties are generally developed by an expensive post-rolling heat treatment comprising either double or single normalising followed by tempering or reheating, quenching and tempering. The normalising or quenching treatment is adopted to provide a microstructure which, on tempering, gives the desired combination of properties.

The present invention sets out to provide an alternative process route particularly suited to the production of nickel steel bar and rod for reinforcement of concrete structures to be subjected to low temperatures, eg temperatures below −40° C.

According to the present invention there is provided a method of producing nickel steel bar or rod in which a bar or rod of such steel is cooled on leaving a rolling mill at a rate which is controlled to produce in the cooled bar or rod a micro-structure which is primarily martensitic. The as-rolled bar or rod may subsequently be tempered without intermediate heat treatment.

The nickel steel may include additions of hardenability elements such as chromium and molybdenum to increase the hardenability of the rod or bar.

The nickel and carbon contents of the steel from which the rod or bar is produced may respectively fall within the following ranges: 4% to 12% and less than 0.15% by weight. Preferred ranges for these elements are nickel 5 or 8 to 10% by weight and carbon less than 0.10% by weight.

In one example of a process in accordance with the invention, billets of a nominally 9% nickel steel of the following composition

| C | Si | Mn | P | S | Ni | Al | N |
|---|---|---|---|---|---|---|---|
| 0.07 | 0.25 | 0.55 | 0.012 | 0.010 | 9.6 | 0.041 | 0.0055 |

were reheated at 1250° C. prior to rolling to 16 and 32 mm ribbed reinforcing bar on a continuous mill. The bars emerged from the last rolling stand at a temperature of 1050° C. and 1070° C. respectively and were subsequently cooled to ambient temperature using a combination of water and air cooling at a rate sufficiently rapid to suppress any extensive formation of undesirable transformation products, eg ferrite and bainite. Table 1 below shows the microstructures developed by this combination of rolling and cooling conditions:

TABLE 1

| Size mm | Constituents | |
|---|---|---|
| 16 and 32 | Martensite | 95% |
| | Bainite | 2-3% |
| | Austenite | 1-3% |

The mechanical properties of the as-rolled bars are shown in Table 2 below:

TABLE 2

| Size mm | Charpy 2mm Impacts-Joules: Room Temperature | −120° C. | −196° C. | Full Section Tensiles: Yield N/mm² | Tensile N/mm² | Elongation % on 5d |
|---|---|---|---|---|---|---|
| 16 | 109/114 | 95/93 | 57/63 | 630 | 1020 | 17 |
| 32 | 120/117 | 74/77 | 29/29 | 688 | 970 | 14 |

It can be seen that, even in this condition, the bars provide an attractive combination of toughness and strength. Tempering of the as-rolled bars at temperatures between 550°-600° C. results in a further improvement in the toughness of the product as exemplified in the data shown in Table 3 below:

TABLE 3

| Size mm | Charpy 2mm V Impacts - Joules: R.T. | −120° C. | −140° C. | −196° C. |
|---|---|---|---|---|
| 16 | 220/213 | 184/200 | 183/180 | 115/110 |
| 32 | 220/220 | 196/200 | 190/196 | 108/77 |

Table 4 below shows the minimum properties specified in British Standard BS1501-509 1970 for a steel of similar composition by the more expensive conventional double normalise or quench and temper route:

TABLE 4

| Yield N/mm² | Tensile N/mm² | El % | Charpy 2mm V Impact - Joules: R.T. | −100° C. | −196° C. |
|---|---|---|---|---|---|
| 525 | 695 | 18 | 67 | 47 | 34 |

It can clearly be seen that the invention as disclosed in the preceding paragraphs provides a product comparable to that achieved by the conventional and more expensive heat temperature route.

It is to be understood that the invention is applicable to the entire range of nickel steels for low temperature applications ranging from 4% to 12% nickel and that the selection of rolling and/or controlled cooling conditions will be determined by the specific composition. The combination of rolling and/or cooling conditions is selected to provide a substantially martensitic structure. It will be understood that such a selection can be made from a knowledge of the continuous cooling transformation diagram for a particular steel taking into account the effects of roll finishing temperature. It will also be understood that, where the cooling installation on a particular mill is incapable of providing sufficiently rapid cooling to prevent premature transformation, the hardenability of the base alloy steel may be increased by the addition of hardenability stabilising elements such as molybdenum and chromium to lower the critical cooling rate.

It will be appreciated that by controlling the cooling rate of bar and rod directly from the hot rolling mill, conventional heat treatments including normalising or quenching can be avoided thereby providing a significant saving in processing costs. Control of the cooling rate is effected to produce a micro-structure in the as-rolled bar which consists primarily of martensite with only a small volume fraction of bainite. This structure is considered ideal for optimal response to the tempering operation and additionally confers a combination of properties to the as-rolled product which are sufficiently attractive to permit the product to be used in all applications other than the very lowest service temperature without resort to tempering.

We claim:

1. A method of producing nickel steel rod or bar of a composition including at least 4% by weight nickel and less than 0.2% by weight carbon, which method comprises the step of cooling a rod or bar of such composition on leaving a rolling mill at a rate which is controlled to produce in the cooled rod or bar a microstructure which is predominately martensitic.

2. A method as claimed in claim 1 wherein the as-rolled rod or bar is subsequently tempered without intermediate heat treatment.

3. A metod as claimed in claim 1 wherein the nickel content of the steel from which the rod or bar is produced whilst within the range of 4% to 12% by weight and wherein the carbon content of such steel is less than 0.15% by weight.

4. A method as claimed in claim 3 wherein the nickel content of the steel lies within the range 5% to 10% by weight and wherein the carbon content is less than 0.15% by weight.

5. A method as claimed in claim 4 wherein the nickel content of such steel lies within the range 8% to 10% by weight.

6. Nickel steel rod or bar produced by a method as claimed in any one of claims 1 to 5.

* * * * *